United States Patent [19]

Ashcraft

[11] Patent Number: 4,660,224

[45] Date of Patent: Apr. 28, 1987

[54] UNISEX BIB-APRON

[76] Inventor: Jeanne Ashcraft, 3360 Pardi Dr., Placerville, Calif. 95667

[21] Appl. No.: 906,980

[22] Filed: Sep. 15, 1986

[51] Int. Cl.[4] ..... A41B 13/10

[52] U.S. Cl. ..... 2/48

[58] Field of Search ..... 2/48, 49, 50, 51, 69

[56] References Cited

U.S. PATENT DOCUMENTS 2,265,690 12/1941 Fiedler ..... 2/49 A 3,557,385 1/1971 Henderson ..... 2/48

*Primary Examiner*—Doris L. Troutman

*Attorney, Agent, or Firm*—Mark C. Jacobs

[57] ABSTRACT

A disposable easy to put on unisex driver's bib-apron for use while dining on fast food. The bib-apron features tuck in panels to help ensure protection of the legs of the wearer. Preferably the bib-apron is made of plastic coated paper or similar materials.

11 Claims, 4 Drawing Figures

UNISEX BIB-APRON

BACKGROUND OF THE INVENTION

In today's fast paced world hundreds of thousands of Americans and other people worldwide visit such fast food chains as McDonalds®, Burger King®, Taco Bell®, Roy Rogers® and the like for lunch and dinner. Many of these chains are installing "drive through" sections such that customers need not exit from their cars in order to partake of fries, shakes and other delicacies. Many of those who use the drive through feature, desire to eat on the go. This idea can indeed cause problems. Strawberry shake does not look good on a grey suit. Nor does catsup blend with a blue tie, be it of silk or polyester, or cotton.

There is therefore a need for something better than the paper napkin which is used more often after the fact than as a soiled blotting preventer.

There is a need therefore for clothing covering that can be easily put on over one's clothing, while waiting in one's car for the person at the window to dispense her gourmet goodies.

It is an object therefore of this invention to provide a easily applied throw away bib-apron that covers the chest waist, and legs of the wearer.

It is another object to provide a bib-apron that tucks over the legs to ensure protection of the knee area of the wearer, while seated in a car.

It is still another object to provide a bib-apron that is so low priced that it can be almost given away by fast food take-out restaurants.

Other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

Known Prior Art

The following relevant references are known to the applicant as the result of a search of the prior art: U.S. Pat. No. 1,391,121 to Keppel; U.S. Pat. No. 2,648,845 to Berman; U.S. Pat. No. 2,683,880 to Krigbaum; U.S. Pat. No. 3,115,639 to Moszczynski; U.S. Pat. No. 3,900,154 to Martin; and U.S. Pat. No. 4,543,668 to Franklin.

SUMMARY OF THE INVENTION

A throwaway bib-apron that fits around the neck and covers the chest and thighs of the wearer who desires to eat in his or her car. The device comprising a flexible member is made of plastic coated paper or plastic or similar material.

DESCRIPTION OF THE PREFERRED EMBODIMENT

Figure 1:
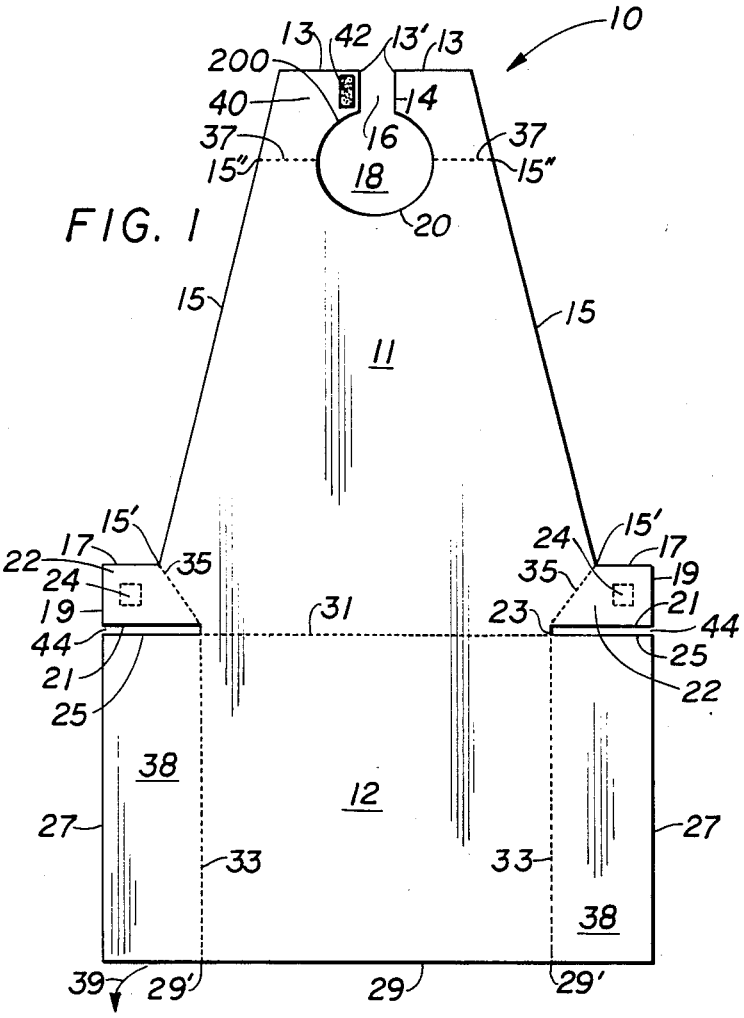
FIG. 1 is a front plan view of the device of this invention.

Turning now to FIG. 1, it is seen that the bib-apron 10 of this invention is a one piece die cut unit, comprising a flexible member of paper, plastic or plastic coated paper or other suitable material having an upper portion 11 and a lower portion 12, which will be described below.

The upper portion 11 is integrally connected to the bottom portion along imaginary line 31, seen as a dotted line in FIG. 1. For ease of understanding the device 10 will be described as a unitary device, but the segregation of upper and lower portions will be described with respect to the usage of the device.

Thus the bib-apron 10 has a pair of spaced axially aligned horizontal top walls 13, which are each connected on their outward edges to a downwardly and outwardly diverging first sidewall 15. Extending outwardly parallel to the top walls at point 15' on each side of the device, at the bottom of the first side walls is lower top wall 17. Since the remainder of the walls, but for the bottom wall are mirror image walls, it shall be understood that 2 of each are intended though only one will be referenced.

At the outer extension of the lower top walls, 17 and pending down generally vertically from each is second sidewall 19. First intermediate wall 21 commences at the vertical termination of the second sidewall 19 and extends parallel to the lower top wall 17, but slightly further inwardly, on the order of about 20% further. At the inner most point of first intermediate wall 21, depending downwardly therefrom a very short distance is second intermediate wall 23. Typically wall 23 is only about 1/32nd to ¼ inch high. It can be as small as no more than the thickness of a cut of the material used for the device 10, or if desired, a full wall up to about ¼ inch can be defined.

Extending outwardly from the terminus of wall 23 is third intermediate wall 25, which is parallel to and of equal length to wall 21. The slot designated 44 separates wall 21 from wall 25.

As has been intimated earlier, dotted imaginary line 31 connects the inner extremities of actual walls 25. If desired this dotted line can be creased upwardly to help ensure that the bib-apron contours to the body of the wearer. Thus reference is made to FIG. 3. It is also to be noted that if desired the imaginary line could also be formed in the format of a horizontal pleat.

Axially aligned with second sidewall 19 and spaced therefrom is third sidewall 27. This extends downward a substantially greater amount than second sidewall 19 but of lesser extension than first sidewall 15.

At the lower end of each third sidewall 27 and connecting the two of them is a horizontal bottom wall 29.

The reader's attention is now returned to the top of FIG. 1. The inner edges of the top walls 13, designated 13' have depending downwardly therefrom in a generally vertical direction an inside wall 14. These two spaced walls may be parallel to each other for ease of die cutting, but they can if desired be non-parallel. The typical downward dependency of walls 14 is about 2 to 4 inches. Found in between these walls 14 is upper slot 16. This slot 16 communicates with a preferably circular cutout 18, which is bounded by preferably arcuate wall 20. Wall 20 while shown as arcuate, again for ease of die cutting, may be square or oval or some other convenient shape as may be desired. Thus reference is made to FIG. 4 which illustrates a variant shape wall designated 120.

Reference is now made to dotted imaginary line 37, which acts almost as a horizontal bisector of cutout 18. This line 37 represents the general location of where the bib-apron of this invention falls on the shoulders of the wearer.

A pair of spaced vertical dotted lines 33 of a length equal to third sidewall 27 extends from the bottom of second intermediate wall 23 to a point 29' on the bottom wall to thus define a side panel 38 within the bottom portion 12. Optionally, as may be desired dotted line 33 may be a downward crease or fold line to help panel 38 drape over the side of the thigh of the wearer in the direction of arrow 39 of FIG. 1, as per FIG. 3.

Tabs 22 formed by walls 17, 19, 21 and imaginary line 35, which last can also optionally be a crease are intended to be removably secured to the wearer's waist section by adhesive pads 24 found on the underside of each of said tabs.

Preferably each of the adhesive pads is covered by a disposable cover sheet to protect the adhesive from contamination or as is well known in the art, and therefore not requiring illustration. The principle is well understood by reference to the typical adhesive bandage.

A pair of neck panels 40 are seen to be integral within the top portion 11. These neck panels are defined by a top wall 13, the corresponding inside wall 14, the segment 200 of wall 20, which segment 200 extends from the lower end of wall 14 to dotted imaginary line 37. The neck panel is further defined by said line 37 and the portion of diverging sidewall 15 upward from point 15'' to the terminus at top wall 13. Again dotted line 37 may be a crease of fold line that extends downward from the plane of the paper similarly to the direction of arrow 39. An adhesive pad 42 is disposed at any suitable location on only one neck panel 40 spaced inwardly slightly from wall 14, on either the top surface or the bottom surface thereof, and is used to secure one neck panel to the other. In the figures, it is shown on the leftwardly one of the two, but it could be on the rightwardly one just as easily. These neck panels, when secured to each other hold the bib apron around the neck of the wearer.

While pads 24 and 42 have been designated as being removably protected adhesive pads, it is readily understood that Velcro brand or other suitable closures could be substituted. Obviously, if such hook type closure were to be used instead of top adhesive pad 42 both the male and female elements as are known in the art would be required to secure the two neck panels to each other. On the other hand, there is a definite possiblity, that the male or hook portion of Velcro if used to replace pad 24 might not adhere to such fabrics as silk taffeta and rayon among others.

In making the device of this invention, I found that suitable dimensions for the various walls, which can be varied both upwardly and downwardly, were as follows:

wall 27—about 17''
wall 17—3''
wall 29—about 29''
wall 14—3''
wall 15—about 26'' in length
wall 13×2—16''
wall 19—about 3''

Figure 4:
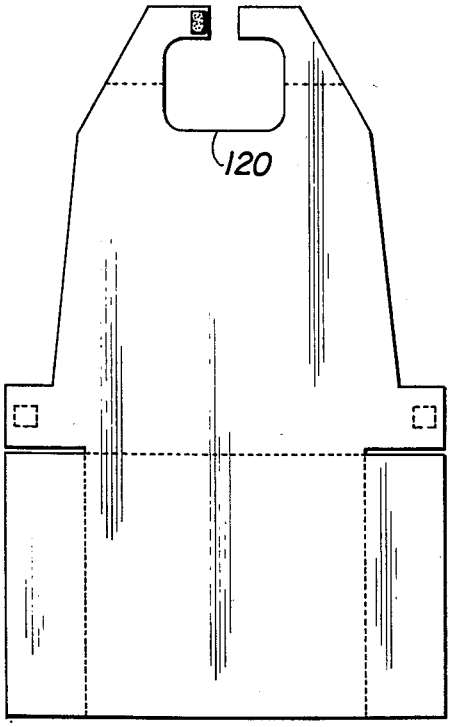
FIG. 4 is a variant of the device of FIG. 1.

It is to be recognized that in FIG. 1, wall 15 is a straight line, while in the format of FIG. 4 the wall is a compound angular line. This wall can be sculpted or made as ornamental as one sees fit.

Figure 2:
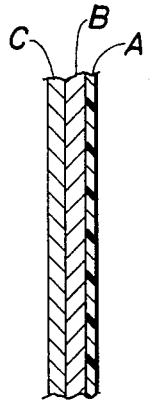
FIG. 2 is diagrammatic sectional view showing the several layers of material utilized herein

Turning now to FIG. 2 the diagrammatic view illustrating the various layers of the device 10. Here, in one embodiment three layers are involved. The top, A, is a plastic film or coating, sprayed or otherwise secured to a first paper layer B, which is bonded to a second paper layer C. The modes of bonding of paper layers is well known in the art, since this practice is utilized in the construction of toilet paper, paper towels, and paper tablecloths among other products.

Figure 3:
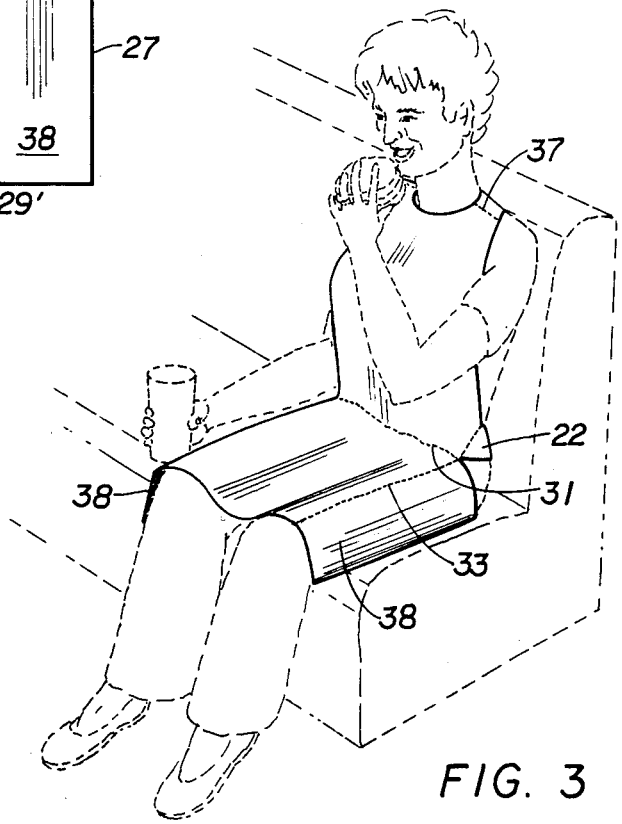
FIG. 3 is a perspective view showing a typical user wearing the device of this invention.

In FIG. 3 we Harriet Housewife, alias Harriet the hamburger lover who does not want to soil her clothes with french fry oil, ketchup, mustard or even taco sauce. She is seen wearing a device 10 while sitting in her car awaiting another scrumptious meal. Note how panels 38 descend over the legs and how line 31 falls at her waist. The tabs 22 are removably adhesed to her waist area.

It is seen that I have provided a most unique low cost bib-apron that can be put on quite easily by the intended wearer and which will protect the clothes of the wearer from food spills and which can be disposed of quite readily at the end of the meal.

By making the instant device of paper, wax or plastic coated, or plastic film or a combination thereof the cost can be kept low so that a restaurant can find fit to give away the instant device for free with the purchase of a meal.

It is also to be seen that the bib-apron of this invention has uses for persons other than automobile drivers. For instance, certain hospital patients who are wheelchair or bed bound could use this invention. As another example airline travelers who have had the experience of coffee or food spill from the snack tray could enjoy the benefit of the instant device.

While it has been indicated that plastic or plastic coated paper may be employed herein, it should also be recognized that there are other suitable materials for this device. Mention therefore may be made of non-woven, non-permeable laminated paper products offered in the marketplace by James River Corporation among others. The additional benefit of this last mentioned product is the biodegradability.

While I have indicated that the device can be die cut, obviously other manufacturing processes such as laser cut, or even manual cutting are contemplated.

Since certain changes may be made in the above product without departing from the scope of the invention involved herein, it is intended that all matter contained in the above description and shown in the accompanying drawings, shall be interpreted as illustrative and not in a limiting sense.

What is claimed is:

1. A throwaway bib-apron for use while dining in one's automobile which comprises a flexible member of paper, or the like adapted to fit around the neck of the wearer and to cover the chest and thighs of the wearer said member having a front surface and a back surface and comprising:

a pair of generally horizontal spaced upper top walls axially aligned, each having an inner end and an outer end, from the outer ends of each of which depend one of a pair of downwardly and outwardly depending elongated first side walls, each of which side walls has a lower end;

a pair of lower top walls, each of which extends outwardly parallel to said upper top walls, one from each of the lower ends of the first side walls;

a pair of second side walls, which depend generally vertically, one from each of the outer terminii of the lower top walls to;

a pair of first intermediate walls, each of which depends inwardly from the end of its respective second sidewall to an inner terminus;

a pair of second intermediate walls each of which depends downwardly from the inner terminus of its respective first intermediate wall to;

a pair of outwardly extending third intermediate walls each commencing at the lower end of its respective second intermediate wall to;

a pair of spaced elongated generally vertical third sidewalls each having a lower end and extending from the outer terminus of its respective third intermediate wall to;

a generally horizontal bottom wall connecting the lower ends of the third sidewalls;

a pair of horizontally spaced vertically extending inside walls each of which has a lower terminus, each inside wall depending from the inner end of one of the spaced upper top walls thereby defining a vertical slot;

a cut out portion defined by a continuous wall extending outwardly from the lower terminus of each of said inside walls, said cut out portion in communication with said vertical slot;

an adhesive pad disposed on the back surface of said member between each lower top wall and its respective first intermediate wall; and an adhesive pad adjacent one of said inside walls.

2. The bib-apron of claim 1 wherein the adhesive pad adjacent one of the inside walls is on the front side of said member.

3. The device of claim 1 wherein the length of each first intermediate wall is greater than the length of each lower top wall.

4. The device of claim 1 wherein the size of each first and third intermediate walls are equal.

5. The device of claim 1 wherein the flexible member has an upper portion and a lower portion said lower portion having a pair of thigh covering panels therein, defined by the area within a rectangular formed by the third intermediate wall, the third side wall, an imaginary line parallel to said third sidewall, normal to the third intermediate wall, at the end thereof opposite the third sidewall, and the requisite portion of the bottom wall.

6. In the device of claim 5 wherein the imaginary line is a vertical crease.

7. The device of claim 1 wherein the third intermediate walls are connected by an upward folding crease.

8. In the device of claim 1 wherein the cutout portion is circular.

9. In the device of claim 1 wherein the cutout portion is oval.

10. The device of claim 1 wherein the flexible member is laminated plastic coated paper.

11. The device of claim 1 wherein the flexible member is non-woven, non-permeable laminated paper.

* * * * *